US008665295B2

(12) United States Patent
Leon et al.

(10) Patent No.: US 8,665,295 B2
(45) **Date of Patent: *Mar. 4, 2014**

(54) ELECTROLUMINESCENT DISPLAY INITIAL-NONUNIFORMITY-COMPENSATED DRVE SIGNAL

(75) Inventors: Felipe A. Leon, Rochester, NY (US); Christopher J. White, Avon, NY (US); Gary Parrett, Rochester, NY (US); Bruno Primerano, Honeoye Falls, NY (US)

(73) Assignee: Global OLED Technology LLC, Herndon, VA (US)

( * ) Notice: Subject to any disclaimer, the term of this patent is extended or adjusted under 35 U.S.C. 154(b) by 1020 days.

This patent is subject to a terminal disclaimer.

(21) Appl. No.: 12/274,559

(22) Filed: Nov. 20, 2008

(65) Prior Publication Data

US 2010/0123699 A1 May 20, 2010

(51) Int. Cl.
*G09G 5/10* (2006.01)

(52) U.S. Cl.
USPC ..... 345/690

(58) Field of Classification Search
USPC ..... 345/690
See application file for complete search history.

(56) References Cited

U.S. PATENT DOCUMENTS 6,081,073 A 6/2000 Salam
6,414,661 B1 7/2002 Shen et al.
6,473,065 B1 10/2002 Fan
6,897,842 B2 5/2005 Gu
6,989,636 B2 1/2006 Cok et al.
7,345,660 B2 3/2008 Mizukoshi et al.
8,026,873 B2 * 9/2011 Leon et al. ..... 345/76
8,194,063 B2 * 6/2012 Levey et al. ..... 345/211
8,217,928 B2 * 7/2012 Levey et al. ..... 345/211
2003/0122813 A1 7/2003 Ishizuki et al.
2003/0174152 A1 * 9/2003 Noguchi ..... 345/690
2005/0007392 A1 1/2005 Kasai et al.
2006/0007248 A1 * 1/2006 Reddy et al. ..... 345/690
2006/0158402 A1 7/2006 Nathan et al.
2006/0273997 A1 12/2006 Nathan et al.
2007/0290958 A1 12/2007 Cok ..... 345/77
2008/0048951 A1 2/2008 Naugler, Jr. et al.

FOREIGN PATENT DOCUMENTS

WO WO 2005/101360 A1 10/2005
WO WO 2009/085113 A2 7/2009

OTHER PUBLICATIONS

Yue Kuo, "Thin Film Transistors: Materials and Processes, vol. 2, Polycrystalline Thin Film Transistors." Boston: Kluwer Academic publishers, 2004. p. 412.

* cited by examiner

*Primary Examiner* — Quan-Zhen Wang
*Assistant Examiner* — Nelson D Runkle, III
(74) *Attorney, Agent, or Firm* — Global OLED Technology LLC

(57) ABSTRACT

An electroluminescent (EL) panel with 2T1C subpixels is compensated for initial nonuniformity ("mura"). The current of each subpixel is measured at a selected time to provide a status signal representing the characteristics of the subpixel. A compensator receives a linear code value and changes it according to the status signals. A linear source driver drives the panel with the changed code values.

9 Claims, 11 Drawing Sheets

30

ELECTROLUMINESCENT DISPLAY INITIAL-NONUNIFORMITY-COMPENSATED DRVE SIGNAL

CROSS REFERENCE TO RELATED APPLICATIONS

Reference is made to commonly-assigned, co-pending U.S. patent application U.S. Ser. No. 11/962,182 entitled "ELECTROLUMINESCENT DISPLAY COMPENSATED ANALOG TRANSISTOR DRIVE SIGNAL" to Leon et al, filed Dec. 21, 2007, incorporated by reference herein.

FIELD OF THE INVENTION

The present invention relates to control of an analog signal applied to a drive transistor for supplying current through an electroluminescent emitter.

BACKGROUND OF THE INVENTION

Flat-panel displays are of great interest as information displays for computing, entertainment, and communications. For example, electroluminescent (EL) emitters have been known for some years and have recently been used in commercial display devices. Such displays employ both active-matrix and passive-matrix control schemes and can employ a plurality of subpixels. Each subpixel contains an EL emitter and a drive transistor for driving current through the EL emitter. The subpixels are typically arranged in two-dimensional arrays with a row and a column address for each subpixel, and having a data value associated with the subpixel. Subpixels of different colors, such as red, green, blue, and white are grouped to form pixels. EL displays can be made from various emitter technologies, including coatable-inorganic light-emitting diode, quantum-dot, and organic light-emitting diode (OLED).

Electroluminescent (EL) flat-panel display technologies, such as organic light-emitting diode (OLED) technology provides benefits in color gamut, luminance, and power consumption over other technologies such as liquid-crystal display (LCD) and plasma display panel (POP). However, such displays suffer from a variety of defects that limit the quality of the displays. In particular, OLED displays suffer from visible nonuniformities across a display. These nonuniformities can be attributed to both the EL emitters in the display and, for active-matrix displays, to variability in the thin-film transistors used to drive the EL emitters.

Some transistor technologies, such as low-temperature polysilicon (LTPS), can produce drive transistors that have varying mobilities and threshold voltages across the surface of a display (Yue Kuo, ed. "Thin Film Transistors: Materials and Processes, Vol. 2, Polycrystalline Thin Film Transistors." Boston: Kluwer Academic Publishers, 2004. Pg. 412). This produces objectionable nonuniformity. Further, nonuniform OLED material deposition can produce emitters with varying efficiencies, also causing objectionable nonuniformity. These nonuniformities are present at the time the panel is sold to an end user, and so are termed initial nonuniformities, or "mura." FIG. 9 shows an example histogram of subpixel luminance exhibiting differences in characteristics between subpixels. All subpixels were driven at the same level, so should have had the same luminance. As FIG. 9 shows, the resulting luminances varied by 20 percent in either direction. This results in unacceptable display performance.

It is known in the prior art to measure the performance of each pixel in a display and then to correct for the performance of the pixel to provide a more uniform output across the display.

U.S. patent application No. 2003/0122813 by Ishizuki et at. discloses a display panel driving device and driving method for providing high-quality images without irregular luminance. The light-emission drive current flowing is measured while each pixel successively and independently emits light. Then the luminance is corrected for each input pixel data based on the measured drive current values. According to another aspect, the drive voltage is adjusted such that one drive current value becomes equal to a predetermined reference current. In a further aspect, the current is measured while an off-set current, corresponding to a leak current of the display panel, is added to the current output from the drive voltage generator circuit, and the resultant current is supplied to each of the pixel portions. The measurement techniques are iterative, and therefore slow. Further, this technique is directed at compensation for aging, not for initial nonuniformity.

U.S. Pat. No. 6,081,073 by Salam describes a display matrix with a process and control means for reducing brightness variations in the pixels. This patent describes the use of a linear scaling method for each pixel based on a ratio between the brightness of the weakest pixel in the display and the brightness of each pixel. However, this approach will lead to an overall reduction in the dynamic range and brightness of the display and a reduction and variation in the bit depth at which the pixels can be operated.

U.S. Pat. No. 6,473,065 by Fan describes methods of improving the display uniformity of an OLED. The display characteristics of all organic-light-emitting-elements are measured, and calibration parameters for each organic-light-emitting-element are obtained from the measured display characteristics of the corresponding organic-light-emitting-element. The calibration parameters of each organic-light-emitting-element are stored in a calibration memory. The technique uses a combination of look-up tables and calculation circuitry to implement uniformity correction. However, the described approaches require either a lookup table providing a complete characterization for each pixel, or extensive computational circuitry within a device controller. This is likely to be expensive and impractical in most applications.

U.S. Pat. No. 7,345,660 by Mizukoshi et al. describes an EL display having stored correction offsets and gains for each subpixel, and having a measurement circuit for measuring the current of each subpixel. Although this apparatus can correct for initial nonuniformity, it uses a sense resistor to measure current, and thus has limited signal-to-noise performance. Furthermore, the measurements required by this method can be very time-consuming for large panels.

U.S. Pat. No. 6,414,661 by Shen et al. describes a method and associated system that compensates for long-term variations in the light-emitting efficiency of individual organic light emitting diodes in an OLED display device by calculating and predicting the decay in light output efficiency of each pixel based on the accumulated drive current applied to the pixel and derives a correction coefficient that is applied to the next drive current for each pixel. This patent describes the use of a camera to acquire images of a plurality of equal-sized sub-areas. Such a process is time-consuming and requires mechanical fixtures to acquire the plurality of sub-area images.

U.S. patent application No. 2005/0007392 by Kasai et al. describes an electro-optical device that stabilizes display quality by performing correction processing corresponding to a plurality of disturbance factors. A grayscale characteristic generating unit produces conversion data having grayscale characteristics obtained by changing the grayscale characteristics of display data that defines the grayscales of pixels with reference to a conversion table whose description contents include correction factors. However, their method requires a large number of LUTs, not all of which are in use at any given time, to perform processing and does not describe a method for populating those LUTs.

U.S. Pat. No. 6,989,636 by Cok et al. describes using a global and a local correction factor to compensate for non-uniformity. However, this method assumes a linear input and is consequently difficult to integrate with image-processing paths having nonlinear outputs.

U.S. Pat. No. 6,897,842 by Gu describes using a pulse width modulation (PWM) mechanism to controllably drive a display (e.g., a plurality of display elements forming an array of display elements). A non-uniform pulse interval clock is generated from a uniform pulse interval clock, and then used to modulate the width, and optionally the amplitude, of a drive signal to controllably drive one or more display elements of an array of display elements. A gamma correction is provided jointly with a compensation for initial nonuniformity. However, this technique is only applicable to passive-matrix displays, not to the higher-performance active-matrix displays which are commonly employed.

There is a need, therefore, for a more complete approach for compensating differences between components in electroluminescent displays, and specifically for compensating for initial nonuniformity of such displays.

SUMMARY OF THE INVENTION

In accordance with the present invention, there is provided, in apparatus for providing analog drive transistor control signals to the gate electrodes of drive transistors in a plurality of electroluminescent (EL) subpixels in an EL panel, including a first voltage supply, a second voltage supply, and the plurality of EL subpixels in the EL panel; each EL subpixel including an EL emitter and a drive transistor with a first supply electrode electrically connected to the first voltage supply and a second supply electrode electrically connected to a first electrode of the EL emitter; and each EL emitter having a second electrode electrically connected to the second voltage supply, the improvement comprising:

a) a measuring circuit for measuring a respective current passing through the first and the second voltage supplies at a selected time to provide a status signal for each subpixel representing the characteristics of the drive transistor and EL emitter in that EL subpixel;

b) means for providing a linear code value for each subpixel;

c) a compensator for changing the linear code values in response to the corresponding status signals to compensate for the differences between characteristics of the drive transistors in the plurality of EL subpixels, and for differences between the characteristics of the EL emitters in the plurality of EL subpixels; and d) a linear source driver for producing the analog drive transistor control signals in response to the changed linear code values for driving the gate electrodes of the drive transistors.

ADVANTAGES

The present invention provides an effective way of providing the analog drive transistor control signal. It requires only one measurement to perform compensation. It can be applied to any active-matrix backplane. The compensation of the control signal has been simplified by using a look-up table (LUT) to change signals from nonlinear to linear so compensation can be in linear voltage domain. It compensates for initial nonuniformity without requiring complex pixel circuitry or external measurement devices. It does not decrease the aperture ratio of a subpixel. It has no effect on the normal operation of the panel. It can raise yield of good panels by making objectionable initial nonuniformity invisible.

DETAILED DESCRIPTION OF THE INVENTION

The present invention compensates for initial nonuniformity of all subpixels on an electroluminescent (EL) panel, e.g. an active-matrix OLED panel. A panel includes a plurality of pixels, each of which includes one or more subpixels. For example, each pixel might include a red, a green, and a blue subpixel. Each subpixel includes an EL emitter, which emits light, and surrounding electronics. A subpixel is the smallest addressable element of a panel.

The discussion to follow first considers the system as a whole. It then proceeds to the electrical details of a subpixel, followed by the electrical details for measuring one subpixel and the timing for measuring multiple subpixels. It next covers how the compensator uses measurements. Finally, it describes how this system is implemented in one embodiment, e.g. in a consumer product, from the factory to end-of-life.

Overview

Figure 1:
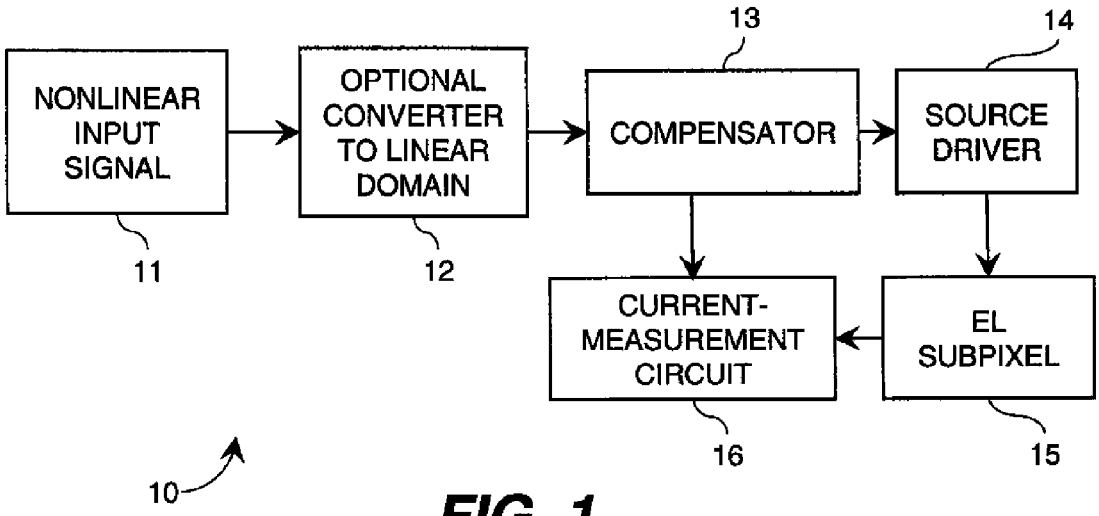
FIG. 1 is a block diagram of a control system for practicing the present invention.

FIG. 1 shows a block diagram of the display system 10 of the present invention. This figure shows data flow for one subpixel; a plurality of subpixels can be processed in this system serially. The nonlinear input signal 11 commands a particular light intensity from an EL emitter in an EL subpixel, which can be one of many on an EL panel. This signal 11 can come from a video decoder, an image processing path, or another signal source, can be digital or analog, and can be nonlinearly-or linearly-coded. For example, the nonlinear input signal can be an sRGB code value or an NTSC luma voltage. Whatever the source and format, the signal is preferentially converted into a digital form and into a linear domain, such as linear voltage, by a converter 12, which will be discussed further in "Cross-domain processing, and bit depth," below. The result of the conversion will be a linear code value, which can represent a commanded drive voltage.

The compensator 13 takes in the linear code value, which can correspond to the particular light intensity commanded from the EL subpixel. The compensator 13 outputs a changed linear code value that will compensate for the effects of initial nonuniformity to cause the EL subpixel to produce the commanded intensity. The operation of the compensator will be discussed further in "Implementation," below.

The changed linear code value from the compensator 13 is passed to a linear source driver 14 which can be a digital-to-analog converter. The linear source driver 14 produces an analog drive transistor control signal, which can be a voltage, in response to the changed linear code value. The linear source driver 14 can be a source driver designed to be linear, or a conventional LCD or OLED source driver with its gamma voltages set to produce an approximately linear output. In the latter case, any deviations from linearity will affect the quality of the results. The linear source driver 14 can also be a time-division (digital-drive) source driver, as taught e.g. in commonly-assigned International Publication No. WO 2005/116971 by Kawabe. A digital-drive source driver provides an analog voltage at a predetermined level commanding light output for an amount of time dependent on the output signal from the compensator. A conventional linear source driver, by contrast, provides an analog voltage at a level dependent on the output signal from the compensator for a fixed amount of time (generally the entire frame). A linear source driver can output one or more analog drive transistor control signals simultaneously.

The analog drive transistor control signal produced by the linear source driver 14 is provided to an EL subpixel 15. This subpixel includes a drive transistor and an EL emitter, as will be discussed in "Display element description," below. When the analog voltage is provided to the gate electrode of the drive transistor, current flows through the drive transistor and EL emitter, causing the EL emitter to emit light. There is generally a linear relationship between current through the EL emitter and luminance of the output emitter, and a nonlinear relationship between voltage applied to the drive transistor and current through the EL emitter. The total amount of light emitted by an EL emitter during a frame can thus be a nonlinear function of the voltage from the linear source driver 14.

The current flowing through the EL subpixel is measured under specific drive conditions by a current-measurement circuit 16, as will be discussed further in "Data collection," below. The measured current for the EL subpixel provides the compensator with the information it needs to adjust the commanded drive signal. This will be discussed further in "Algorithm," below.

This system can compensate for variations in drive transistors and EL emitters in an EL panel over the operational lifetime of the EL panel, as will be discussed further in "Sequence of operations," below.

The present invention can compensate for differences in characteristics and the resulting nonuniformities at any selected time. However, nonuniformities are particularly objectionable to end users seeing a display panel for the first time. The operating life of an EL display is the time from when an end user first sees an image on that display to the time when that display is disposed of. Initial nonuniformity is any nonuniformity present at the beginning of the operating life of a display. The present invention can advantageously correct for initial nonuniformity by taking measurements before the operating life of the EL display begins. Measurements can be taken in the factory as part of production of a display. Measurements can also be taken after the user first activates a device containing an EL display, immediately before showing the first image on that display. This allows the display to present a high-quality image to the end user when he first sees it, so that his first impression of the display will be favorable.

Display Element Description

Figure 8:
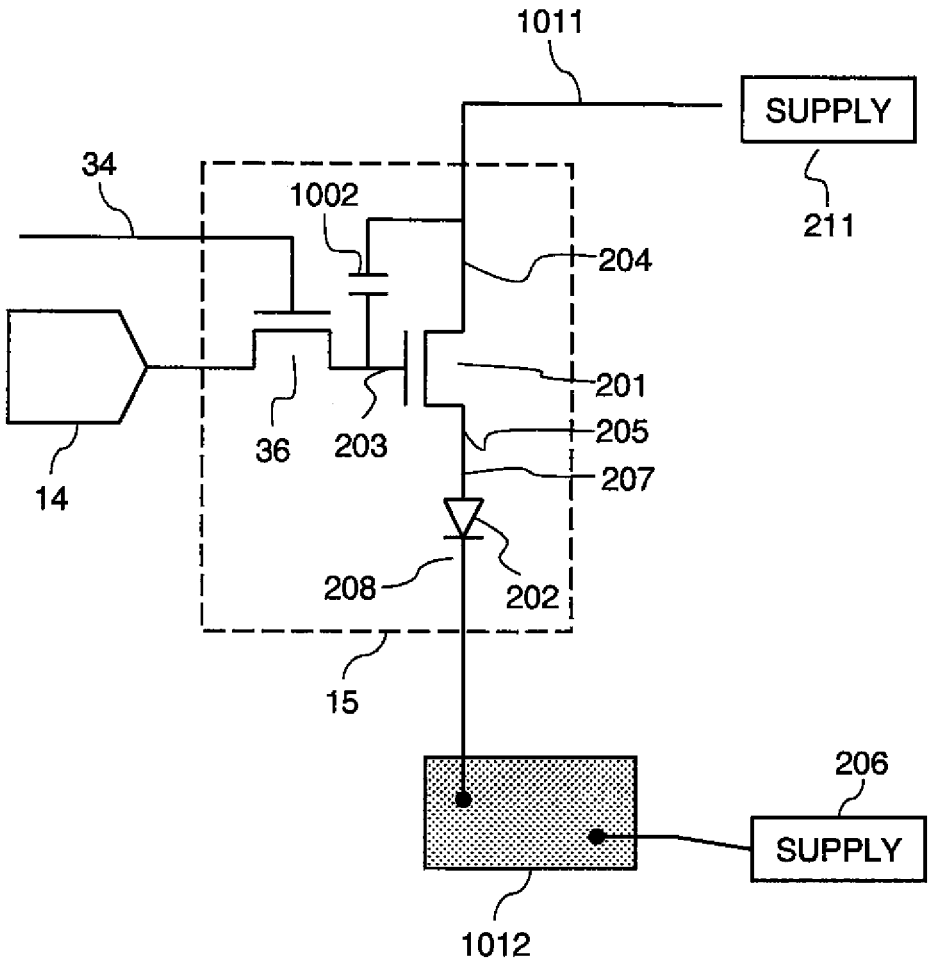
FIG. 8 is a detailed schematic of one embodiment of an EL subpixel and surrounding circuitry according to the present invention.
Figure 9:
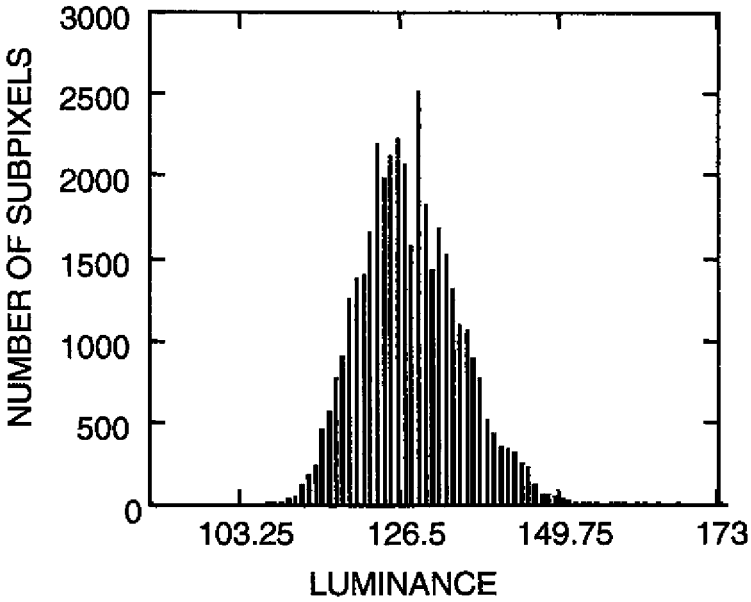
FIG. 9 is a histogram of luminances of subpixels exhibiting differences in characteristics.

FIG. 8 shows one embodiment of an EL subpixel and surrounding circuitry. EL subpixel 15 includes drive transistor 201, EL emitter 202, and optionally select transistor 36 and storage capacitor 1002. First voltage supply 211 ("PVDD") can be positive, and second voltage supply 206 ("Vcom") can be negative. The EL emitter 202 has a first electrode 207 and a second electrode 208. The drive transistor has a gate electrode 203, a first supply electrode 204 which can be the drain of the drive transistor, and a second supply electrode 205 which can be the source of the drive transistor. An analog drive transistor control signal can be provided to the gate electrode 203, optionally through a select transistor 36, which is activated by row line 34. The analog drive transistor control signal can be stored in storage capacitor 1002. The first supply electrode 204 is electrically connected to a first voltage supply 211. The second supply electrode 205 is electrically connected to the first electrode 207 of the EL emitter 202. The second electrode 208 of the EL emitter is electrically connected to a second voltage supply 206. The power supplies are typically located off the EL panel. Electrical connection can be made through switches, bus lines, conducting transistors, or other devices or structures capable of providing a path for current.

In one embodiment of the present invention, first supply electrode 204 is electrically connected to first voltage supply 211 through PVDD bus line 1011, second electrode 208 is electrically connected to second voltage supply 206 through sheet cathode 1012, and the gate electrode 203 of drive transistor 201 is driven with the analog drive transistor control signal produced by linear source driver 14.

Figure 2:
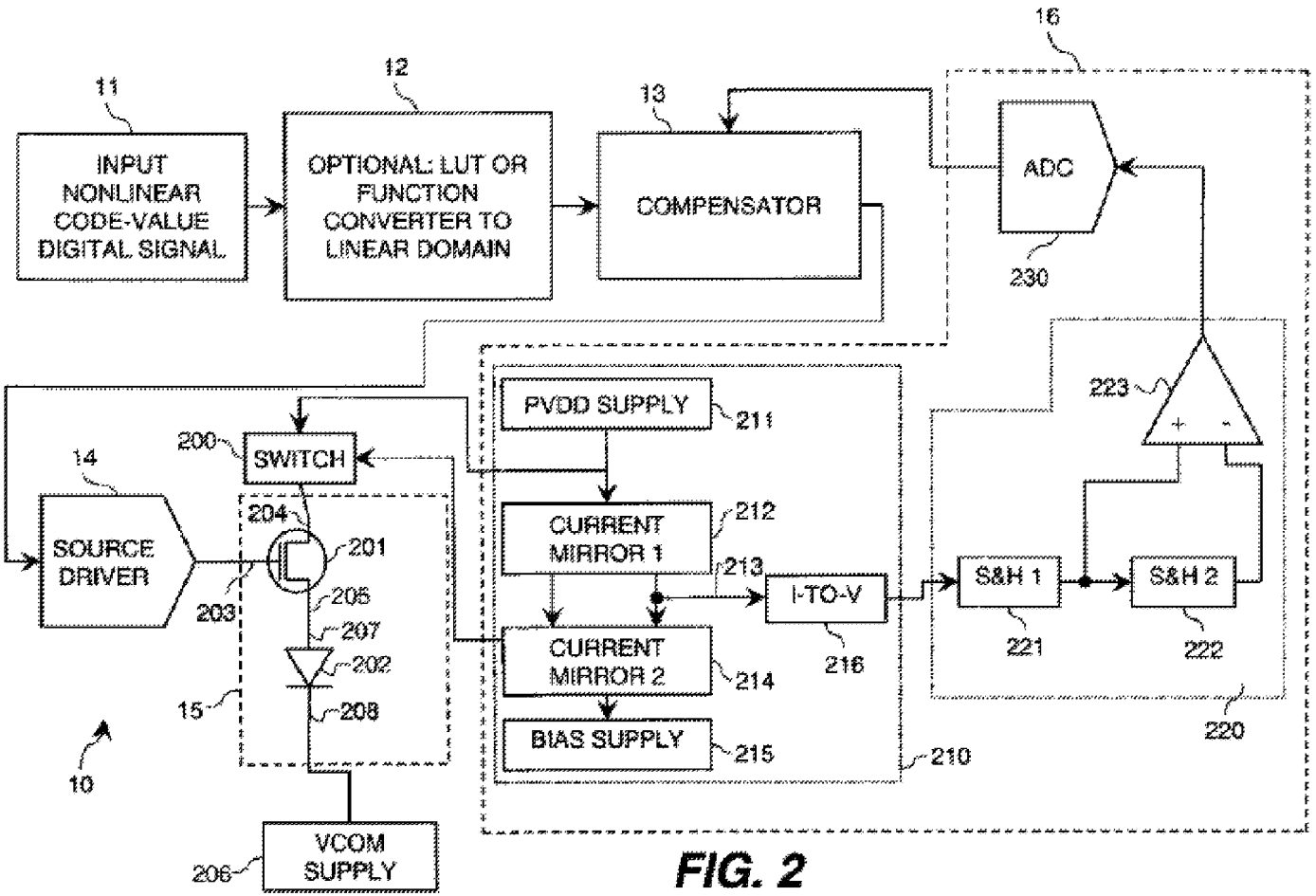
FIG. 2 is a detailed schematic of the control system shown in FIG. 1.

FIG. 2 shows the EL subpixel 15 in the context of display system 10, including nonlinear input signal 11, converter 12, compensator 13, and linear source driver 14 as shown in FIG. 1. As described above, the drive transistor 201 has with gate electrode 203, first supply electrode 204 and second supply electrode 205. The EL emitter 202 has first electrode 207 and second electrode 208. The system has voltage supplies 211 and 206.

Neglecting leakage, the same current passes from first voltage supply 211, through the first supply electrode 204 and the second supply electrode 205 of the drive transistor 201, through the EL emitter electrodes 207 and 208, to the second voltage supply 206. Therefore, current can be measured at any point in this drive current path. The drive current is what causes EL emitter 202 to emit light. Current can be measured off the EL panel at the first voltage supply 211 to reduce the complexity of the EL subpixel.

Data Collection

Hardware

Still referring to FIG. 2, to measure the current of each EL subpixel quickly, accurately, and without relying on any special electronics on the panel, the present invention employs a measuring circuit 16 comprising a current mirror unit 210, a correlated double-sampling (CDS) unit 220, and an analog-to-digital converter (ADC) 230.

The current mirror unit 210 can be attached to voltage supply 211 or anywhere else in the drive current path. First current mirror 212 supplies drive current to the EL subpixel 15 through switch 200, and produces a mirrored current on its output 213. The mirrored current can be equal to the drive current or a function of the drive current. For example, the mirrored current can be a multiple of the drive current to provide additional measurement-system gain. Second current mirror 214 and bias supply 215 apply a bias current to the first current mirror 212 to reduce the impedance of the first current mirror as seen from the panel, advantageously reducing the time required to take a measurement. This circuit also reduces changes in the current through the EL subpixels being measured due to voltage changes in the current mirror resulting from current draw of the measurement circuit. This advantageously improves signal-to-noise ratio over other current-measurement options, such as a simple sense resistor, which can change voltages at the drive transistor terminals depending on current. Finally, current-to-voltage (I-to-V) converter 216 converts the mirrored current from the first current mirror into a voltage signal for further processing. I-to-V converter 216 can include a transimpedance amplifier or a low-pass filter. For a single EL subpixel, the output of the I-to-V converter can be the status signal for that subpixel. For measurements of multiple subpixels, as will be discussed below, the measurement circuitry can include further circuitry responsive to the voltage signal for producing a status signal. A respective measurement is taken of each subpixel, and a corresponding status signal produced.

Switch 200, which can be a relay or FET, can selectively, electrically connect the measuring circuit to the drive current flow through the first and second electrodes of the drive transistor 201. During measurement, the switch 200 can electrically connect first voltage supply 211 to first current mirror 212 to allow measurements. During normal operation, the switch 200 can electrically connect first voltage supply 211 directly to first supply electrode 204 rather than to first current mirror 212, thus removing the measuring circuit from the drive current flow. This causes the measurement circuitry to have no effect on normal operation of the panel. It also advantageously allows the measurement circuit's components, such as the transistors in the current mirrors 212 and 214, to be sized only for measurement currents and not for operational currents. As normal operation generally draws much more current than measurement, this allows substantial reduction in the size and cost of the measurement circuit.

To drive a current for the measurement circuit to measure, compensator 13 can cause the linear source driver 14 to produce one or more test analog drive transistor control signals at a selected time. The measurement circuit 16 can then measure, for each subpixel 15, a current corresponding to each of the one or more test analog drive transistor control signals. The status signal can then include the one or more respective measured currents and the one or more test analog drive transistor control signals that caused them, or be calculated from those currents and voltages as will be described below. The linear source driver 14 can also produce analog drive transistor control signals which deactivate subpixels in a column once that column has been measured, e.g. by causing the drive transistor to enter the cutoff region.

Sampling

The current mirror unit 210 allows measurement of the current for one EL subpixel. To measure the current for multiple subpixels, in one embodiment the present invention uses correlated double-sampling, with a timing scheme usable with standard OLED source drivers.

Figure 3:
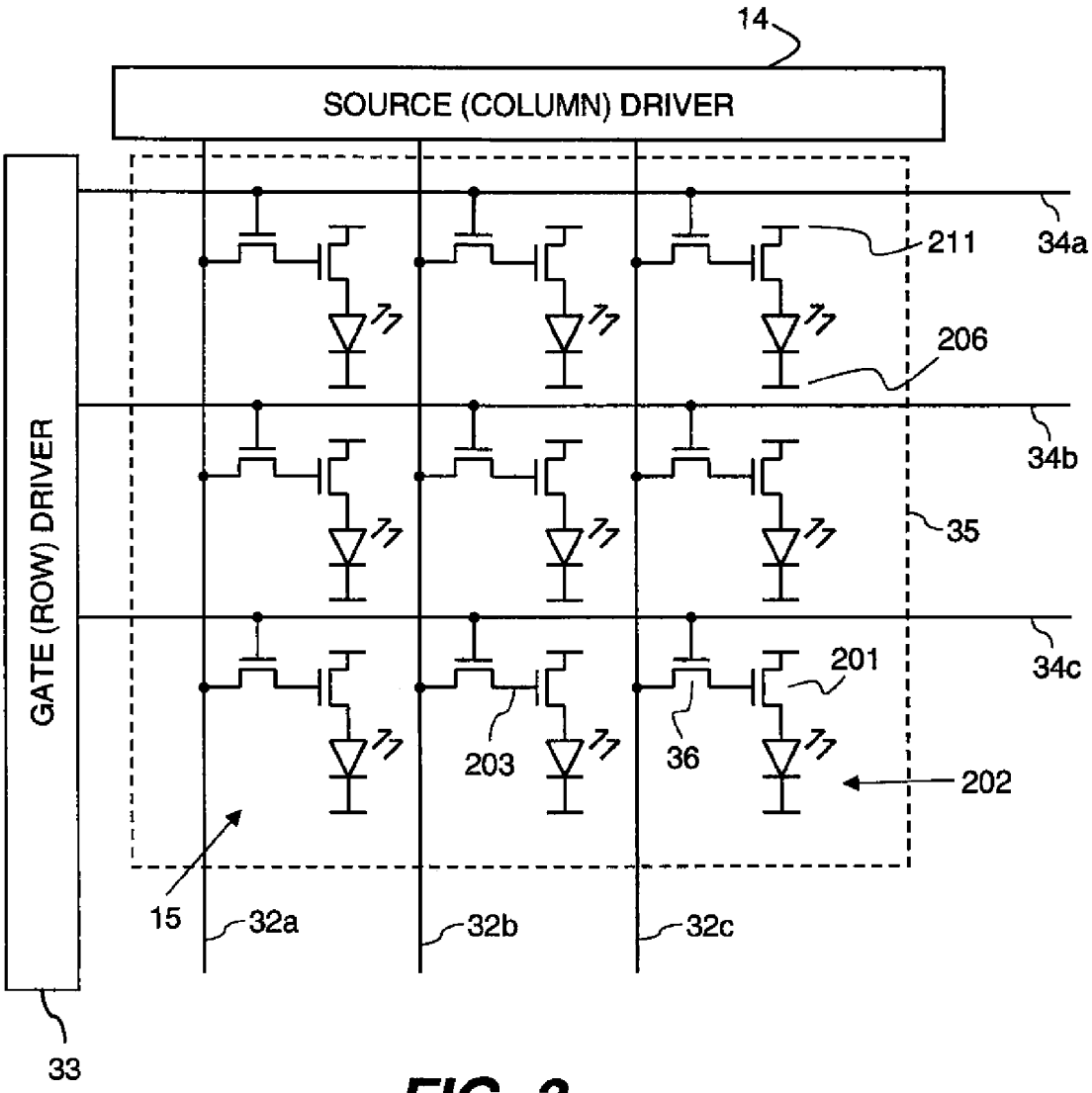
FIG. 3 is a diagram of an EL panel which can be used in the practice of the present invention.

Referring to FIG. 3, an EL panel 30 useful in the present invention has three main components: a source driver 14 driving column lines 32*a*, 32*b*, 32*c*, a gate driver 33 driving row lines 34*a*, 34*b*, 34*c*, and a subpixel matrix 35. In one embodiment of the present invention, the source driver 14 can include one or more linear source drivers 14. The subpixel matrix 35 includes a plurality of EL subpixels 15 in an array of rows and columns. Note that the terms "row" and "column" do not imply any particular orientation of the EL panel. EL subpixel 15, EL emitter 202, drive transistor 201, and select transistor 36 are as shown in FIG. 8. The gate of select transistor 36 is electrically connected to the appropriate row line 34, and of its source and drain electrodes, one is electrically connected to the appropriate column line 32, and one is connected to the gate electrode 203 of the drive transistor 201. Whether the source is connected to the column line or the drive transistor gate electrode does not affect the operation of the select transistor.

For clarity, voltage supplies 211 and 206, as shown in FIG. 8, are indicated on FIG. 3 where they connect to each subpixel, as the present invention can be employed with a variety of schemes for connecting the supplies with the subpixels.

In typical operation of this panel, the source driver 14 drives appropriate analog drive transistor control signals on the respective column lines 32*a*, 32*b*, and 32*c*. The gate driver 33 then activates the first row line 34*a*, causing the appropriate control signals to pass through the select transistors 36 to the gate electrodes 203 of the appropriate drive transistors 201 to cause those transistors to apply current to their attached EL emitters 202. The gate driver 33 then deactivates the first row line 34*a*, preventing control signals for other rows from corrupting the values passed through the select transistors 36. The source driver 14 drives control signals for the next row on the column lines, and the gate driver 33 activates the next row 34*b*. This process repeats for all rows. In this way all subpixels on the panel receive appropriate control signals, one row at a time. The row time is the time between activating one row line (e.g. 34*a*) and activating the next (e.g. 34*b*). This time is generally constant for all rows.

According to the present invention, this row stepping is used advantageously to activate only one subpixel at a time, working down a column. Referring to FIG. 3, suppose only column 32*a* is driven, starting with all subpixels off. Column line 32*a* will have an analog drive transistor control signal, such as a high voltage, causing subpixels attached thereto to emit light; all other column lines 32*b* . . . 32*c* will have a control signal, such as a low voltage, causing subpixels attached thereto not to emit light. Those control signals can be produced by linear source driver 14. Since all subpixels are off, the panel is drawing a dark current, which can be zero or only a leakage amount. As rows are activated, the subpixels attached to column 32*a* turn on, and so the total current drawn by the panel rises.

Figure 4:
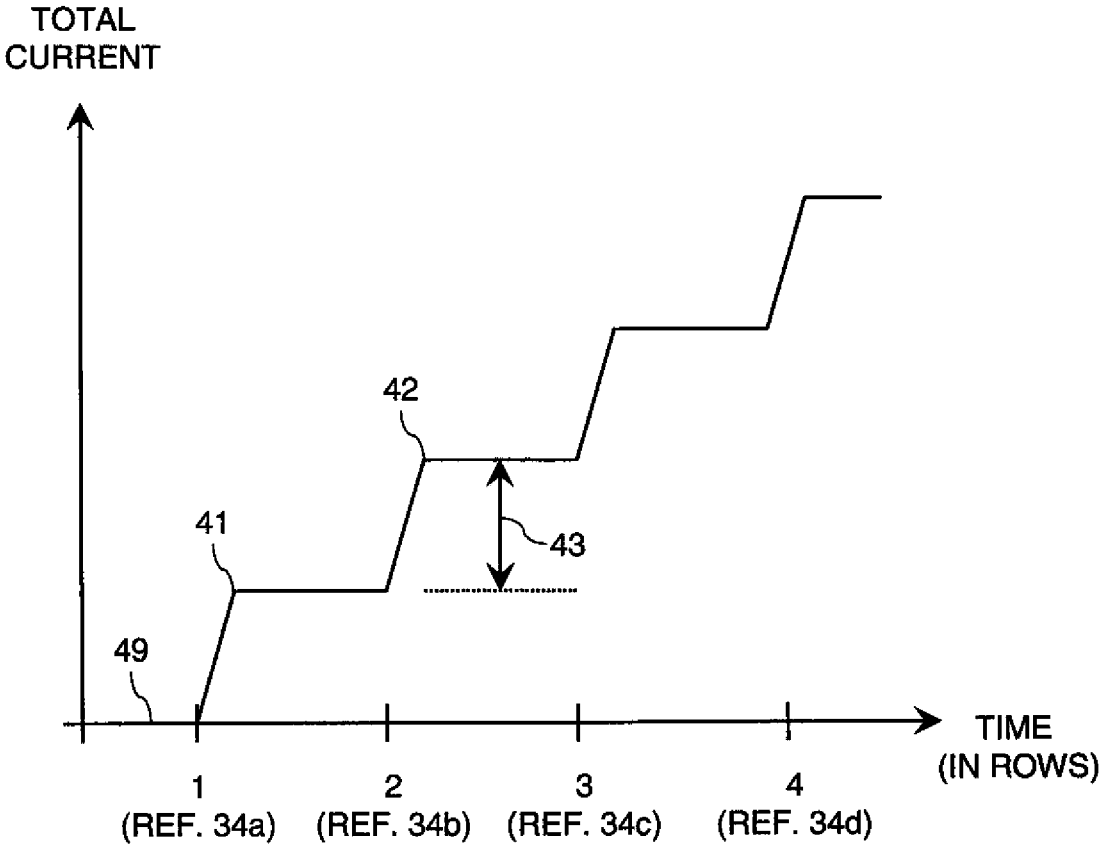
FIG. 4 is a timing diagram for operating a measurement circuit shown in FIG. 2.

Referring now to FIG. 4, and also to FIGS. 2 and 3, measurement 49 is taken of the dark current. Then, at time 1, a subpixel is activated (e.g. with row line 34*a*) and its current 41 measured with measuring circuit 16. Specifically, what is measured is the voltage signal from the current-measurement circuit, which represents the current through the first and second voltage supplies as discussed above; measuring the voltage signal representing current is referred to as "measuring current" for clarity. Current 41 is the sum of the current from the first subpixel and the dark current. At time 2, the next subpixel is activated (e.g. with row line 34*b*) and current 42 is measured. Current 42 is the sum of the current from the first subpixel, the current from the second subpixel, and the dark current. The difference between the second measurement 42 and the first measurement 41 is the current 43 drawn by the second subpixel. In this way the process proceeds down the first column, measuring the current of each subpixel. The second column is then measured, then the rest of the panel, one column at a time. After a column is measured, all subpixels in that column can be deactivated before the next column is measured. This can be done by stepping down rows deactivating one subpixel at a time. Note that while measuring down a column, each measurement (e.g. 41, 42) is taken as soon after activating a subpixel as possible. In an ideal situation, each measurement can be taken any time before activating the next subpixel, but as will be discussed below, taking measurements immediately after activating a subpixel can help remove error due to self-heating effects. This method allows measurements to be taken as fast as the settling time of a subpixel will allow.

Referring back to FIG. 2, and also referring to FIG. 4, correlated double-sampling unit 220 samples the measured currents to produce status signals. In hardware, currents are measured by latching their corresponding voltage signals from current mirror unit 210 into the sample-and-hold units 221 and 222 of FIG. 2. The voltage signals can be those produced by I-to-V converter 216. Differential amplifier 223 takes the differences between successive subpixel measurements. The output of sample-and-hold unit 221 is electrically connected to the positive terminal of differential amplifier 223 and the output of unit 222 is electrically connected to the negative terminal of amplifier 223. For example, when current 41 is measured, the measurement is latched into sample-and-hold unit 221. Then, before current 42 is measured (latched into unit 221), the output of unit 221 is latched into second sample-and-hold unit 222. Current 42 is then measured. This leaves current 41 in unit 222 and current 42 in unit 221. The output of the differential amplifier, the value in unit 221 minus the value in unit 222, is thus (voltage signal representing) current 42 minus (voltage signal representing) current 41, or difference 43. Each current difference, e.g. 43, can be the status signal for a corresponding subpixel. For example, current difference 43 can be the status signal for the subpixel attached to row line 34*b* and column line 32*a*. In this way, stepping down the rows and across the columns, measurements can be taken of each subpixel. Measurements can successively be taken at a variety of drive levels (gate voltages or current densities) to form I-V curves for each of the measured subpixels.

Algorithm

Figure 5A:
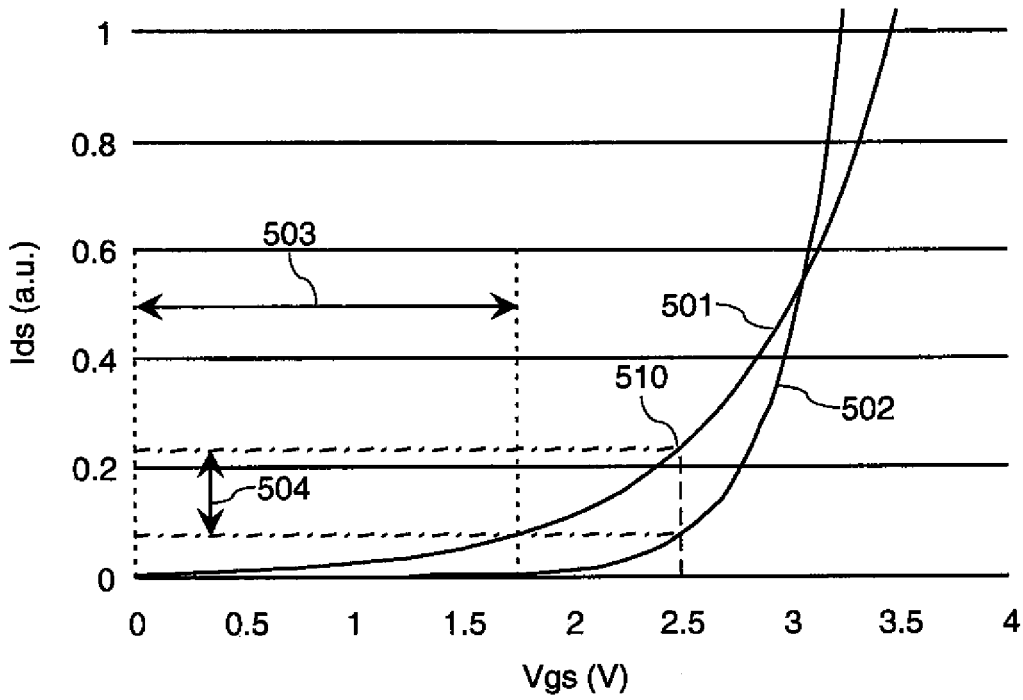
FIG. 5A is a representative I-V characteristic curve of two subpixels, showing differences in characteristics.

Referring to FIG. 5A, I-V curves 501 and 502 are representative characteristics of a first and a second subpixel, respectively. The I-V curves of the different subpixels differ in slope, and in shift on the gate voltage axis. The shift is due to a difference in $V_{th}$, in keeping with the MOSFET saturation-region drive transistor equation, $I_d=K(V_{gs}-V_{th})^2$ (Lurch, N. *Fundamentals of electronics,* 2e. New York: John Wiley & Sons, 1971, pg. 110). The difference in $V_{th}$ is shown as threshold voltage difference 503. The slope difference can be caused by differences in mobility of the drive transistor or in voltage or resistance of the EL emitter.

At a measurement reference gate voltage 510, the currents produced by the first and second subpixels differ by an amount shown as current difference 504. In practice, curves 501 and 502 are generally linear transforms of each other. This allows an offset and a gain to be used to compensate rather than full stored I-V curves for each subpixel. A reference I-V curve can be selected, e.g. the mean of curves 501 and 502. A gain and an offset can then be computed for each curve with respect to the reference by fitting techniques known in the statistical art. The gain and offset together constitute a status signal for the subpixel, and represent the characteristics of the drive transistor and EL emitter in that EL subpixel. The measurements can be used directly to make status signals, or an average of a number of measurements, an exponentially-weighted moving average of measurements over time, or the result of other smoothing methods which will be obvious to those skilled in the art.

In general, the current of a subpixel can be higher or lower than that of another subpixel. For example, higher temperatures cause more current to flow, so a lightly-aged subpixel in a hot environment can draw more current than an unaged subpixel in a cold environment. The compensation algorithm of the present invention can handle either case.

Figure 5B:
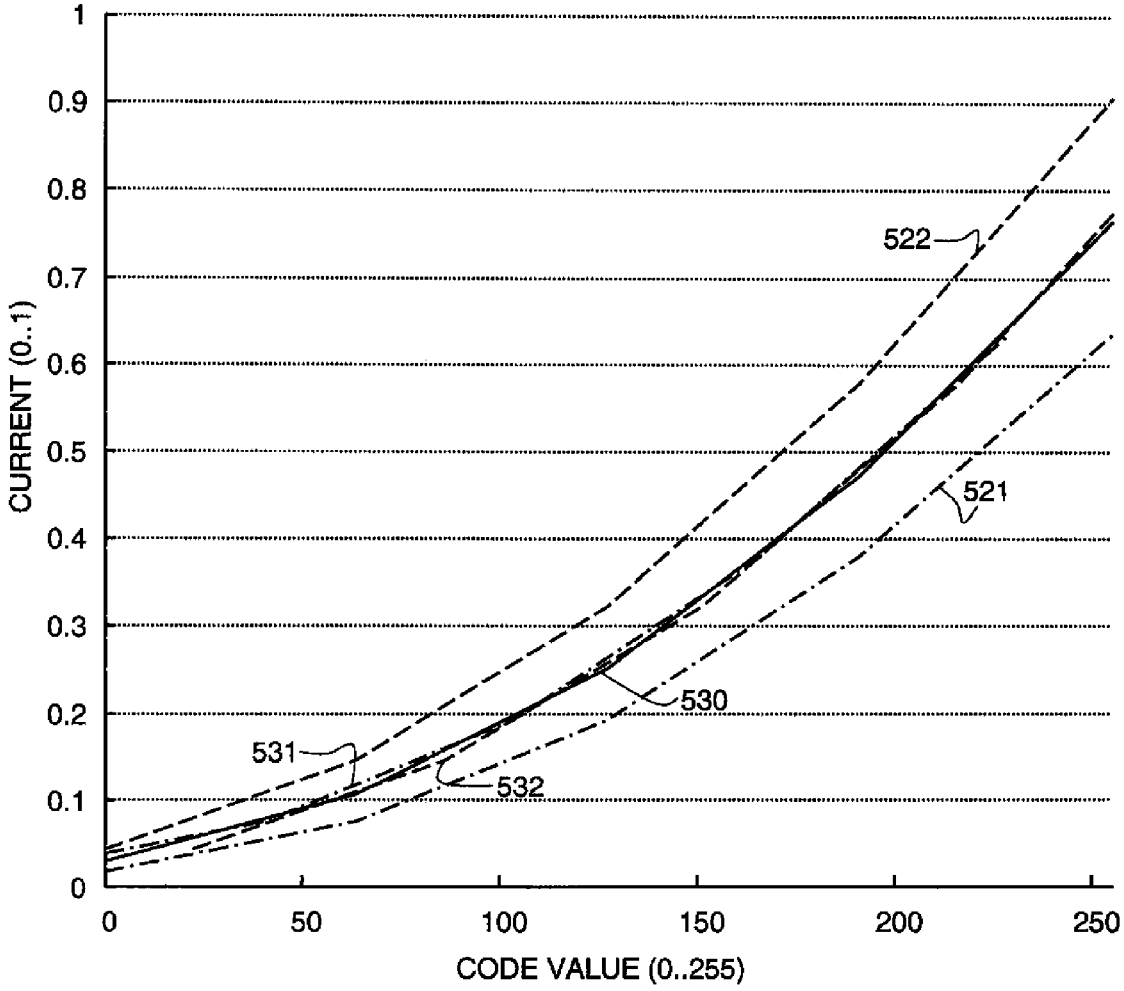
FIG. 5B is an example I-V curve measurement of multiple subpixels.

FIG. 5B shows an example of measured I-V curve data. The abscissa is code value (0 . . . 255), which corresponds to voltage e.g. through a linear map. The ordinate is normalized current on a 0 . . . 1 scale. I-V curves 521 (dash-dot) and 522 (dashed) correspond to two different subpixels on an EL panel, selected to represent extremes of variation on the EL panel. Reference I-V curve 530 (solid) is a reference curve calculated as the mean of the I-V curves of all subpixels on the panel. Compensated I-V curves 531 (dash-dot) and 532 (dashed) are the compensated results for I-V curves 521 and 522, respectively. Both I-V curves closely match the reference after compensation.

The reference I-V curve can also be calculated as the mean of the I-V curves of the subpixels in a particular region of the panel. Multiple reference I-V curves can be provided for different regions of the panel or for different color channels.

Figure 5C:
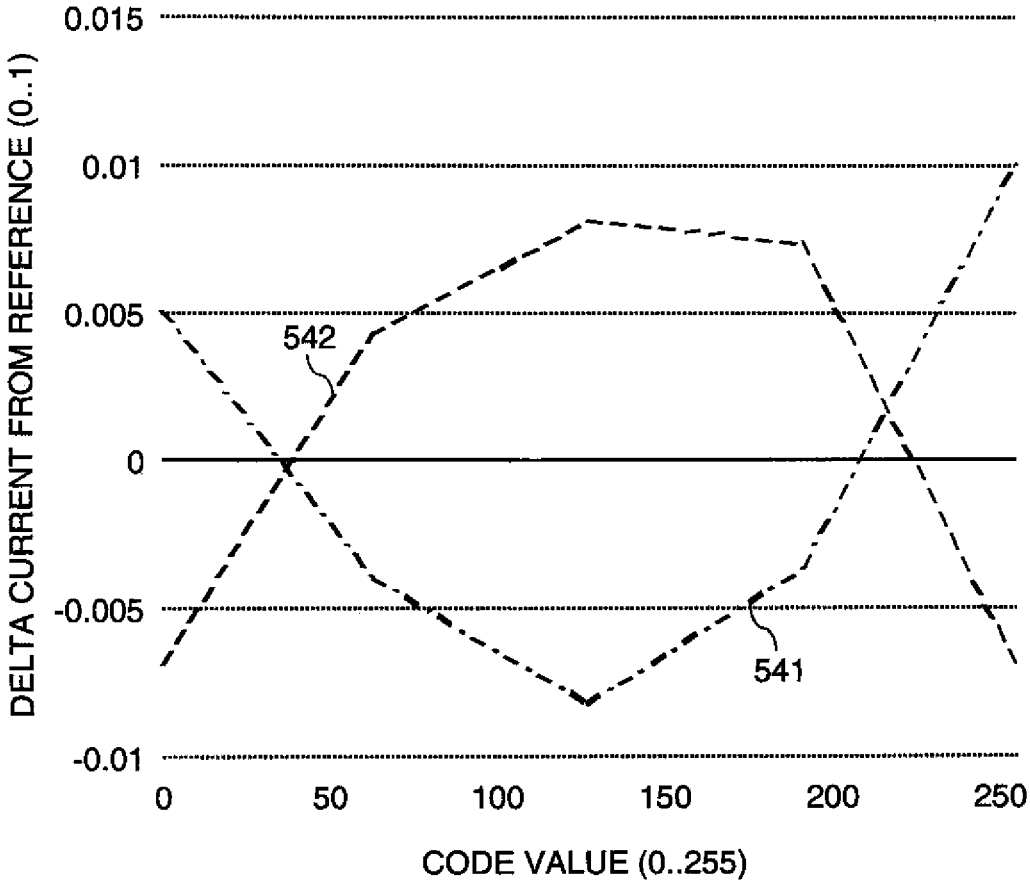
FIG. 5C is a plot of the effectiveness of compensation.

FIG. 5C shows the effectiveness of compensation. The abscissa is code value (0 . . . 255). The ordinate is current delta (0 . . . 1) between the reference and the compensated I-V curves. Error curves 541 and 542 correspond to I-V curves 521 and 522 after compensation using a gain and offset. The total error is within approximately ±1% across the full code value range, indicating a successful compensation. In this example, error curve 541 was calculated with gain=1.2, offset=0.013, and error curve 542 with gain=0.0835, offset=−0.014.

Implementation

Figure 6:
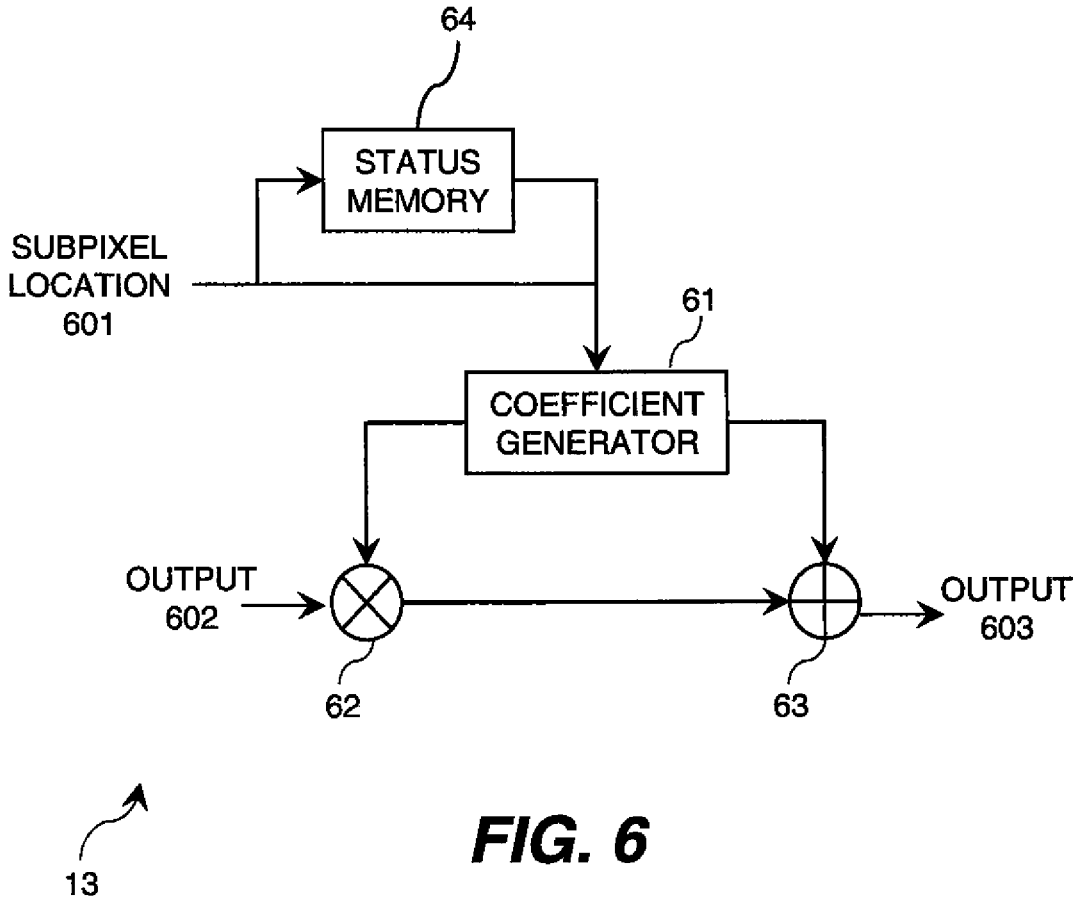
FIG. 6 is a block diagram of the compensator of FIG. 1.

Referring to FIG. 6, there is shown an embodiment of compensator 13. The compensator operates on one subpixel at a time; multiple subpixels can be processed serially. For example, compensation can be performed for each subpixel as its linear code value arrives from a signal source in the conventional left-to-right, top-to-bottom scanning order. Compensation can be performed on multiple pixels simultaneously by paralleling multiple copies of the compensation circuitry or by pipelining the compensator as is known in the art.

The inputs to compensator 13 are the position of a subpixel 601 and the linear code value of that subpixel (input 602), which can represent a commanded drive voltage. The compensator changes the linear code value (LCV) to produce a changed linear code value (CLCV) for a linear source driver, which can be e.g. a compensated voltage out 603. The position 601 is used to retrieve the status signal for the subpixel from status memory 64. Compensation coefficients are then produced by coefficient generator 61 using the status signal and optionally the position 601. The coefficient generator can be a LUT or a passthrough. The coefficients are an offset and a gain for each subpixel. Status memory 64 and coefficient generator 61 can be implemented together as a single LUT. Multiplier 62 multiplies the LCV by the gain, and adder 63 adds the offset to the multiplied LCV to produce the CLCV (output 603).

Status memory 64 holds a stored reference status signal measurement of each subpixel taken at a selected time. The status signal measurements can be status signals output by the measuring circuit described in "Data collection," above. Status memory 64 can store the reference status signals in non-volatile RAM, such as a Flash memory, ROM, such as EEPROM, or NVRAM.

Cross-Domain Processing, and Bit Depth

Image-processing paths known in the art typically produce nonlinear code values (NLCVs), that is, digital values having a nonlinear relationship to luminance (Giorgianni & Madden. *Digital Color Management encoding solutions*. Reading, Mass.: Addison-Wesley, 1998. Ch. 13, pp. 283-295). Using nonlinear outputs matches the input domain of a typical source driver, and matches the code value precision range to the human eye's precision range. However, compensation is a voltage-domain operation, and thus is preferably implemented in a linear-voltage space. A linear source driver can be used, and domain conversion performed before the source driver, to effectively integrate a nonlinear-domain image-processing path with a linear-domain compensator. Note that this discussion is in terms of digital processing, but analogous processing can be performed in an analog or mixed digital/analog system. Note also that the compensator can operate in linear spaces other than voltage. For example, the compensator can operate in a linear current space.

Figure 7:
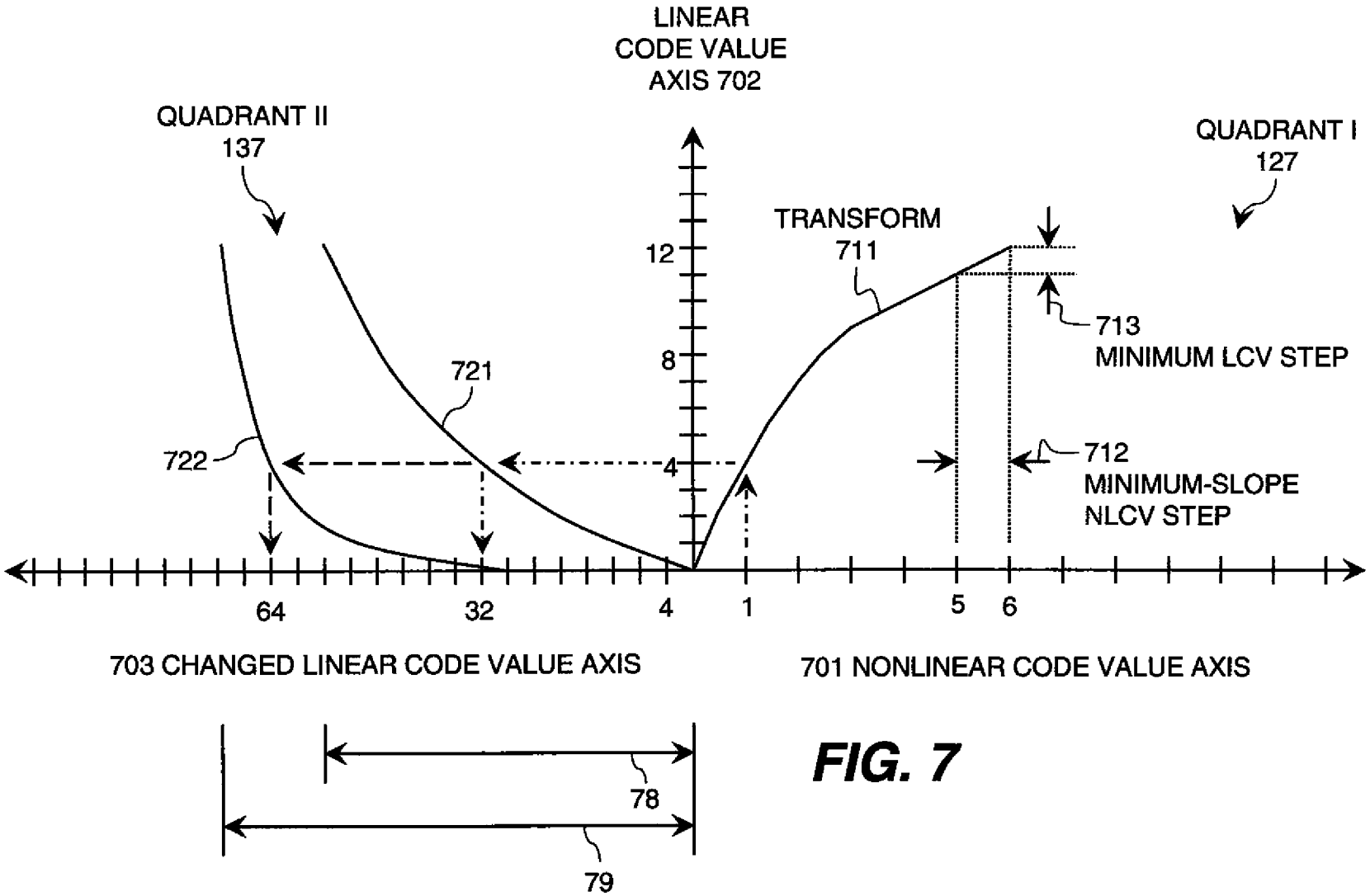
FIG. 7 is a Jones-diagram representation of the effect of a domain-conversion unit and a compensator.

Referring to FIG. 7, there is shown a Jones-diagram representation of the effect of a domain-conversion unit 12, in Quadrant I 127, and a compensator 13, in Quadrant II 137. This figure shows the mathematical effect of these units, not how they are implemented. The implementation of these units can be analog or digital. Quadrant I represents the operation of the domain-conversion unit 12: nonlinear input signals, which can be nonlinear code values (NLCVs), on axis 701 are converted by mapping them through transform 711 to form linear code values (LCVs) on axis 702. Quadrant II represents the operation of compensator 13: LCVs on axis 702 are mapped through transforms such as 721 and 722 to form changed linear code values (CLCVs) on axis 703.

Referring to Quadrant I, domain-conversion unit 12 receives NLCVs and converts them to LCVs. This conversion can preferably be performed with sufficient resolution to avoid objectionable visible artifacts such as contouring and crushed blacks. In digital systems, NLCV axis 701 can be quantized, as indicated in FIG. 7. LCV axis 702 should have thus sufficient resolution to represent the smallest change in transform 711 between two adjacent NLCVs. This is shown as NLCV step 712 and corresponding LCV step 713. As the LCVs are by definition linear, the resolution of the whole LCV axis 702 should be sufficient to represent step 713. The LCVs can thus preferably be defined with finer resolution than the NLCVs in order to avoid loss of image information. The resolution can be twice that of step 713 by analogy with the Nyquist sampling theorem.

Transform 711 is an ideal transform for a reference subpixel. It has no relationship to any subpixel or the panel as a whole. Specifically, transform 711 is not modified due to any $V_{th}$ or $V_{EL}$ variations. There can be one transform for all colors, or one transform for each color. The domain-conversion unit, through transform 711, advantageously decouples the image-processing path from the compensator, allowing the two to operate together without having to share information. This simplifies the implementation of both.

Referring to Quadrant II, compensator 13 changes LCVs to changed linear code values (CLCVs) on a per-subpixel basis, in response to the per-subpixel status signals. In this example, curves 721 and 722 represent the compensator's behavior for a first and a second subpixel, respectively. $V_{th}$ differences will require curves such as 721 and 722 to shift left and right on axis 703. Consequently, the CLCVs will generally require a larger range than the LCVs in order to provide headroom for compensation, that is, to avoid clipping the compensation of subpixels with high $V_{th}$ voltages.

Following the dash-dot arrows, an NLCV of 1 is transformed by the domain-conversion unit 12 through transform 711 to an LCV of 4, as indicated in Quadrant I. For a first subpixel, the compensator 13 will pass that through curve 721 as a CLCV of 32, as indicated in Quadrant II. For a second subpixel with a higher $V_{th}$, the LCV of 4 will be converted through curve 722 to a CLCV of 64. The compensator thus compensates for the differences between characteristics of the drive transistors in the plurality of EL subpixels, and for differences between the characteristics of the EL emitters in the plurality of EL subpixels.

In various embodiments, the domain-converter 12 can be implemented as a look-up table or function analogous to an LCD source driver to perform this conversion. The domain-converter can receive code values from an image-processing path of eight bits or more.

The compensator can take in an 11-bit linear code value representing the desired voltage and produce a 12-bit changed linear code value to send to a linear source driver 14. The linear source driver can then drive the gate electrode of the drive transistor of an attached EL subpixel in response to the changed linear code value. The compensator can have greater bit depth on its output than its input to provide headroom for compensation, that is, to extend the voltage range 78 to voltage range 79 and keep the same resolution across the new, expanded range, as required for minimum linear code value step 713. The compensator output range can extend below the range of curve 711 as well as above it, e.g. when curve 711 is the mean of many subpixels' I-V curves, so actual I-V curves are disposed on both sides of curve 711.

Each panel design can be characterized to determine what the maximum transistor and EL emitter differences will be over a production run, and the compensator and source drivers can have enough range to compensate.

Sequence of Operations

Before mass-production of a particular OLED panel design begins, the design is characterized to determine resolution required in the domain-conversion unit 12 and in the compensator 13. Resolution required can be characterized in conjunction with a panel calibration procedure such as co-pending commonly-assigned U.S. application Ser. No. 11/734,934, "CALIBRATING RGBW DISPLAYS" by Alessi et al., filed Apr. 13, 2007, incorporated by reference herein. These determinations can be made by those skilled in the art.

Once the design has been characterized, mass-production can begin. At a selected time, e.g. manufacturing time or another time before the operating life of the panel, one or more I-V curves are measured for each panel produced. These panel curves can be averages of curves for multiple subpixels. There can be separate curves for different colors, or for different regions of the panel. Current can be measured at enough drive voltages to make a realistic I-V curve; any errors in the I-V curve can affect the results. Also at manufacturing time, respective reference currents can be measured for each subpixel 15 on the panel and respective status signals computed. The I-V curves and reference currents are stored with the panel.

The EL subpixel 15 shown in FIGS. 2 and 8 is for an N-channel drive transistor and a non-inverted (common-cathode) EL structure: the EL emitter 202 is tied to the second supply electrode 205, which is the source electrode of drive transistor 201, higher voltages on the gate electrode 203 command more light output, and voltage supply 211 is more positive than second voltage supply 206, so current flows from 211 to 206. However, this invention is applicable to any combination of P— or N-channel drive transistors and non-inverted or inverted (common-anode) EL emitters, using appropriate well-known modifications to the circuits. This invention is also applicable to low-temperature polysilicon (LTPS), amorphous silicon (a-Si) or zinc oxide transistors. The drive transistor 201 and select transistors 36 can be any of these types, or other types known in the art.

In a preferred embodiment, the invention is employed in a panel that includes Organic Light Emitting Diodes (OLEDs), which are composed of small molecule or polymeric OLEDs as disclosed in, but not limited to, U.S. Pat. No. 4,769,292 by Tang et al. and U.S. Pat. No. 5,061,569 by VanSlyke et al. In this embodiment, each EL emitter is an OLED emitter. Many combinations and variations of organic light emitting diode materials can be used to fabricate such a panel. This invention also applies to EL emitters other than OLEDs. Although the modes of characteristic differences of other EL emitter types can be different than those described herein, the measurement, modeling, and compensation techniques of the present invention can still be applied.

The invention has been described in detail with particular reference to certain preferred embodiments thereof, but it will be understood that variations and modifications can be effected within the spirit and scope of the invention.

Parts List

10 display system
11 nonlinear input signal
12 converter to voltage domain
13 compensator
14 linear source driver
15 EL subpixel
16 current-measurement circuit
30 EL panel
32*a* column line
32*b* column line
32*c* column line
33 gate driver
34 row line
34*a* row line
34*b* row line
34*c* row line
35 subpixel matrix
36 select transistor
41 measurement
42 measurement
43 difference
49 black-level measurement
61 coefficient generator
62 multiplier
63 adder
64 status memory
78 voltage range
79 voltage range
127 quadrant
137 quadrant
200 switch
201 drive transistor
202 EL emitter
203 gate electrode
204 first supply electrode
205 second supply electrode
206 voltage supply
207 first electrode
208 second electrode
210 current mirror unit
211 voltage supply
212 first current mirror
213 first current mirror output
214 second current mirror
215 bias supply
216 current-to-voltage converter
220 correlated double-sampling unit
221 sample-and-hold unit
222 sample-and-hold unit
223 differential amplifier
230 analog-to-digital converter
501 I-V curve
502 I-V curve
503 threshold voltage difference
504 current difference
510 measurement reference gate voltage
521 I-V curve
522 I-V curve
530 reference I-V curve
531 compensated I-V curve
532 compensated I-V curve
541 error curve
542 error curve
601 subpixel location
602 commanded voltage
603 compensated voltage
701 axis
702 axis
703 axis
711 transform
712 step
713 step
721 transform
722 transform
1002 storage capacitor
1011 bus line
1012 sheet cathode

The invention claimed is:

1. An apparatus for providing analog drive transistor control signals to the gate electrodes of drive transistors in a plurality of electroluminescent (EL) subpixels in an EL panel, including a first voltage supply, a second voltage supply, and the plurality of EL subpixels in the EL panel; each EL subpixel including an EL emitter and a drive transistor with a first supply electrode electrically connected to the first voltage supply and a second supply electrode electrically connected to a first electrode of the EL emitter; and each EL emitter having a second electrode electrically connected to the second voltage supply, the apparatus comprising:

a) a measuring circuit for measuring a respective current passing through the first and the second voltage supplies at a selected time to provide a status signal for each subpixel representing current-voltage characteristics of the drive transistor and EL emitter in that EL subpixel, and providing a linear code value for the current-voltage characteristics of each subpixel;

b) a compensator for changing the linear code values in response to the corresponding status signals to compensate for the differences between characteristics of the drive transistors in the plurality of EL subpixels, and for differences between the characteristics of the EL emitters in the plurality of EL subpixels; and c) a linear source driver for producing the analog drive transistor control signals in response to the changed linear code values for driving the gate electrodes of the drive transistors;

wherein the measuring circuit includes:

i) a current to voltage converter for producing a voltage signal; and ii) a correlated double-sampling unit responsive to the voltage signal for providing a current differential as the status signal to the compensator.

2. The apparatus of claim 1 wherein each EL emitter is an OLED emitter.

3. The apparatus of claim 1 wherein each drive transistor is a low-temperature polysilicon transistor.

4. The apparatus of claim 1, wherein the measuring circuit further includes:

iii) a first current mirror for providing the current passing through the first and the second voltage supplies to the current to voltage converter;

iv) a switch for selectively electrically connecting the first current mirror to the first voltage supply; and v) a second current mirror connected to the first current mirror to reduce impedance of the first current mirror.

5. The apparatus of claim 1, further comprising a memory for storing the corresponding status signals of each subpixel and wherein the compensator uses the stored corresponding status signals while producing the respective changed linear code values.

6. The apparatus of claim 1, wherein each status signal comprises a gain and an offset calculated from the current-voltage curves of each subpixel.

7. The apparatus of claim 1, wherein the linear source driver produces one or more test analog drive transistor control signals at the selected time, wherein the measurement circuit measures a current corresponding to each of the one or more test analog drive transistor control signals, and wherein each status signal comprises the one or more respective currents and the one or more test analog drive transistor control signals.

8. The apparatus of claim 1 further including means for receiving a nonlinear input signal and for converting the nonlinear input signal to the linear code value.

9. The apparatus of claim 1, wherein the selected time is before the operating life of the EL panel.

* * * * *